US005214232A

United States Patent [19]

Iijima et al.

[11] Patent Number: 5,214,232

[45] Date of Patent: May 25, 1993

[54] ELECTRIC STRINGED MUSICAL INSTRUMENT EQUIPPED WITH DETECTOR OPTICALLY DETECTING STRING VIBRATIONS

[75] Inventors: Kenzaburo Iijima; Katsufumi Kondo, both of Shizuoka, Japan

[73] Assignee: Yamaha Corporation, Hamamatsu, Japan

[21] Appl. No.: 778,235

[22] Filed: Oct. 17, 1991

[30] Foreign Application Priority Data

Oct. 18, 1990 [JP] Japan ..... 2-280878

[51] Int. Cl.[5] ..... G10H 3/18

[52] U.S. Cl. ..... 84/724; 84/723; 84/742; 84/743

[58] Field of Search ..... 84/724, 743, DIG. 19, 84/DIG. 30, 723, 742

[56] References Cited

U.S. PATENT DOCUMENTS 4,688,460 8/1987 McCoy ..... 84/724
4,730,530 3/1988 Bonanno .
4,815,353 3/1989 Christian ..... 84/724
5,012,086 4/1991 Barnard ..... 84/724

FOREIGN PATENT DOCUMENTS 921738 2/1973 Canada .
3243563 5/1984 Fed. Rep. of Germany .

*Primary Examiner*—William M. Shoop, Jr.
*Assistant Examiner*—Helen Kim
*Attorney, Agent, or Firm*—Burns, Doane, Swecker & Mathis

[57] ABSTRACT

An electric guitar has a plurality of strings stretched over a rigid body and a neck, and a vibration detecting unit embedded into the rigid body, and the vibration detecting unit has a plurality of photo emitting elements paired with a plurality of photo detecting elements spaced apart from the associated photo emitting diodes in directions parallel to the associated strings, wherein the photo emitting elements radiate light spots toward the associated strings for causing the reflections to be fallen upon the associated photo detecting elements so that the photo detecting elements produces photo currents without any diffraction of light.

6 Claims, 4 Drawing Sheets

ELECTRIC STRINGED MUSICAL INSTRUMENT EQUIPPED WITH DETECTOR OPTICALLY DETECTING STRING VIBRATIONS

FIELD OF THE INVENTION

This invention relates to an electric musical instrument such as an electric guitar and, more particularly, to a vibration detector optically detecting the vibrations produced in a string.

DESCRIPTION OF THE RELATED ART

Vibration detectors optically detecting vibrations of strings are disclosed in Japanese Patent Application laid-open No. 59-140497 and in U.S. Pat. No. 4,730,530. The Japanese Patent Application laid-open No. 59-140497 is assigned to Japanese Patent Application No. 58-220877 which claimed the Convention Priority on the basis of German Patent Application No. P3243563.0. The vibration detector disclosed in the Japanese Patent Application laid-open consists of an incandescent lamp unit, and a condenser lens unit, and the incandescent lamp unit and the condenser lens unit are provided on both sides of six strings stretched over a body. The incandescent lamp unit laterally radiates across the six strings, and the optical radiation is fallen upon the condenser lens unit. The condenser lens unit is associated with a photo-electric converting circuit, and the output voltage level of the photo-electric converting circuit is varied together with the amount of the shadow of the strings. The amount of the shadow is dependent upon the vibrations, and the output voltage is indicative of the vibrations produced in the strings.

The vibration detector disclosed in the United States Patent consists of infrared unit for producing infrared rays associated with a pair of photo detectors. The infrared unit is positioned under strings, and the pair of photo detectors are located over a string in opposing relation to the infrared detectors. The infrared unit upwardly radiates, and the infrared rays are fallen upon the detectors. The vibrations are detectable as the amount of the shadow of the string as similar to previously described prior art.

A problem is encountered in the first prior art vibration detector in that assembly work is time-consuming and elaborate. In detail, the condenser lens unit is so far from the incandescent lamp unit that the optical path can not be aligned with the condenser lens unit. In other words, the assembly work frays the worker's nerves, and prolonged time period is consumed. Moreover, even if the optical path is adjusted onto the condenser lens unit, the optical path is much liable to go out of tune, and the output voltage level hardly reflect the vibrations.

The second prior art vibration detector has a problem in complex structure because of the pair of photo detectors opposed to the infrared unit, and highly accurate assembly work is also required.

Moreover, both prior art vibration detectors are of the transmission type across strings, and vibrations produced in a thin string are hardly detectable due to diffraction of light. In other words, the prior art vibration detectors are not reliable.

SUMMARY OF THE INVENTION

It is therefore an important object of the present invention to provide an electric stringed musical instrument which is equipped with highly reliable simple vibration detectors.

To accomplish these objects, the present invention proposes to use reflection of photo radiation.

In accordance with the present invention, there is provided an electric stringed musical instrument comprising a) a body, b) at least one string stretched over the body, c) a detecting unit fixed to the body, and located below the at least one string, the detecting unit having at least one photo emitting element for radiating light toward the at least one string, and a photo detecting element receiving reflection of the light from the at least one string and producing photo current indicative of the intensity of the reflection, the intensity of the reflection being varied when the at least one string is vibrated, and d) sound producing means supplied with the photo current for producing sounds.

BRIEF DESCRIPTION OF THE DRAWINGS

The features and advantages of the electric musical stringed instrument according to the present invention will be more clearly understood from the following description taken in conjunction with the accompanying drawings in which.

DESCRIPTION OF THE PREFERRED EMBODIMENT

Figure 1:
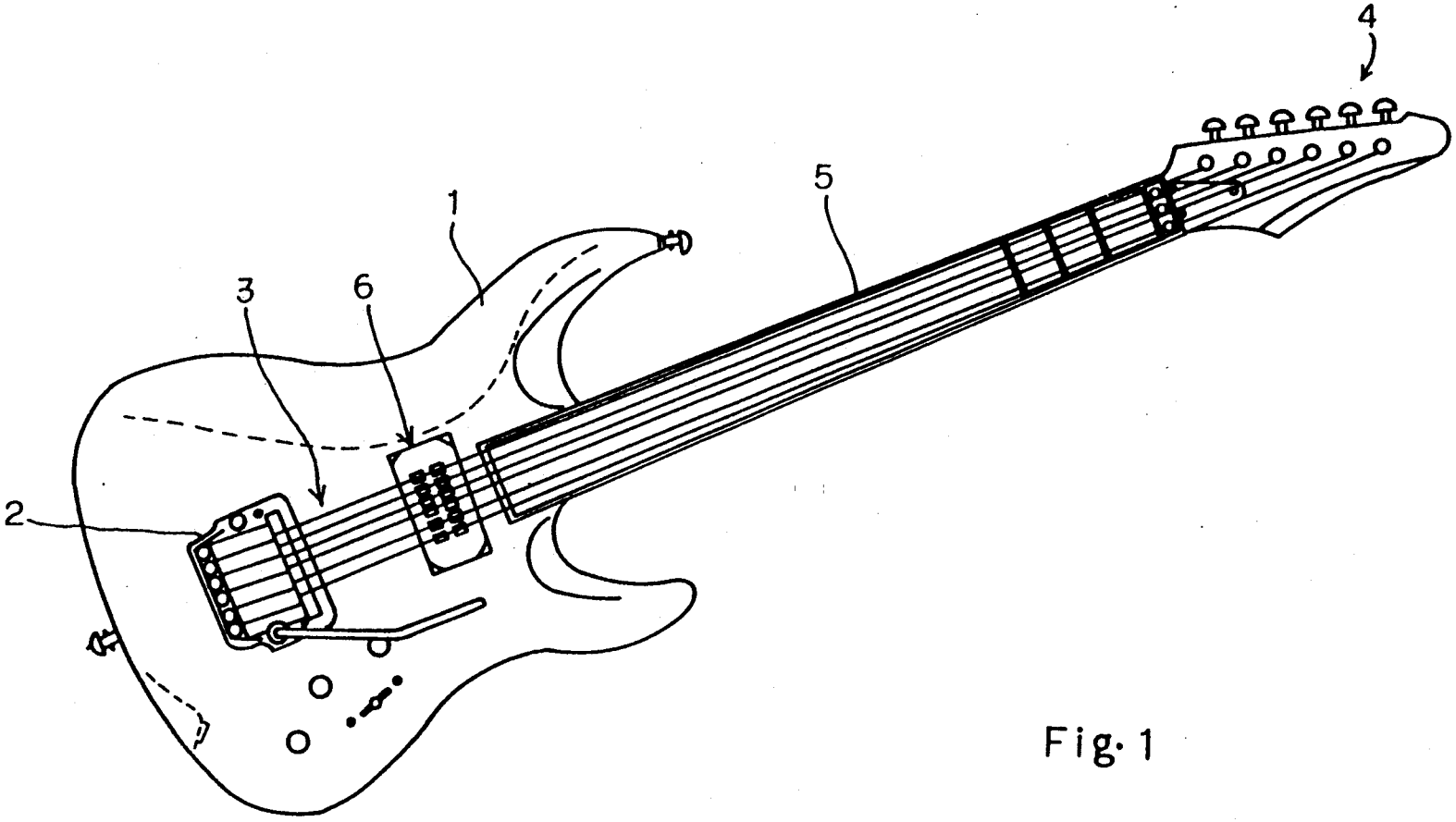
FIG. 1 is a front view showing an electric guitar equipped with a vibration detecting unit according to the present invention.

Referring first to FIG. 1 of the drawings, an electric guitar embodying the present invention largely comprises a rigid body 1, a tremolo unit 2 swingably supported by the rigid body 1, strings 3 stretched over the rigid body 1 between the tremolo unit 2 and the pegs at the leading end portion of a neck 5 projecting from the rigid body 1. In this instance, there are six strings which are labeled with 3*a* to 3*f*. The electric guitar further comprises a vibration detecting unit 6, and the vibration detecting unit 6 is provided beneath the six strings 3*a* to 3*f*. In this instance, the vibration detecting unit 6 is partially embedded in the rigid body 1, and the vibration detecting unit 6 has photo emitting elements 6*aa*, 6*ab*, 6*ac*, 6*ad*, 6*ae* and 6*af* respectively paired with photo detecting elements 6*ba*, 6*bb*, 6*bc*, 6*bd*, 6*be* and 6*bf*. The photo emitting elements 6*aa* to 6*af* are implemented by photo emitting diodes, and the photo detecting elements are of a photo detecting diode. Each of the photo detecting elements 6*ba* to 6*bf* produces photo current proportional to the amount of light.

Figure 2:
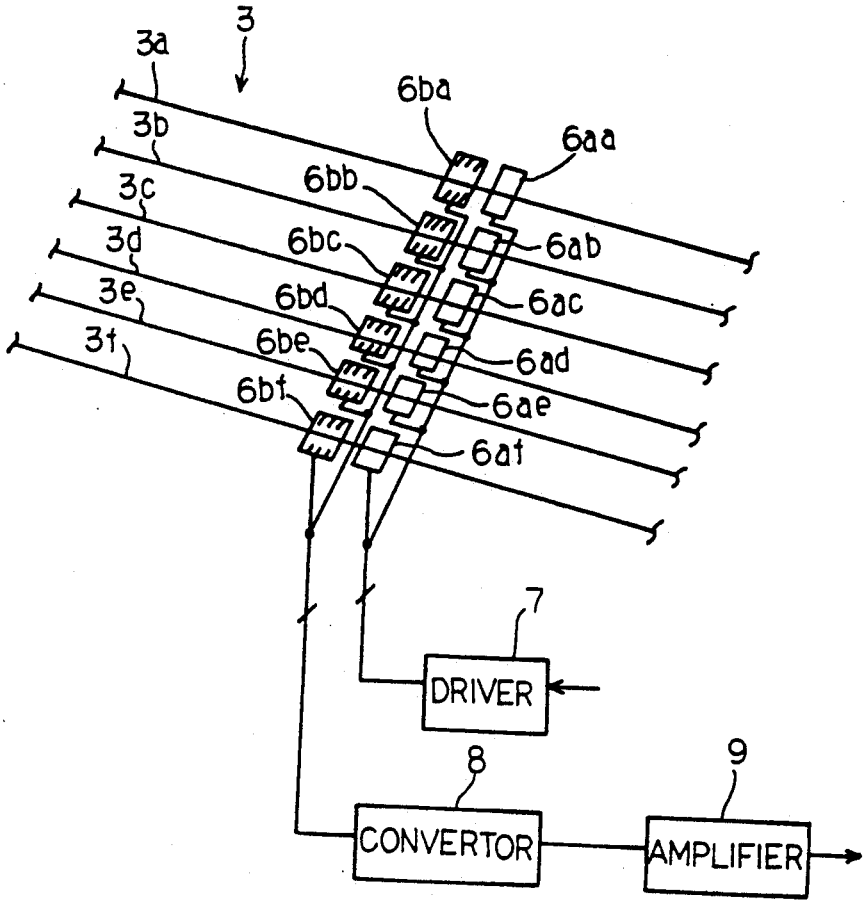
FIG. 2 is a view showing the arrangement of photo emitting elements paired with photo detecting elements provided in association with the strings of the electric guitar.
Figure 3:
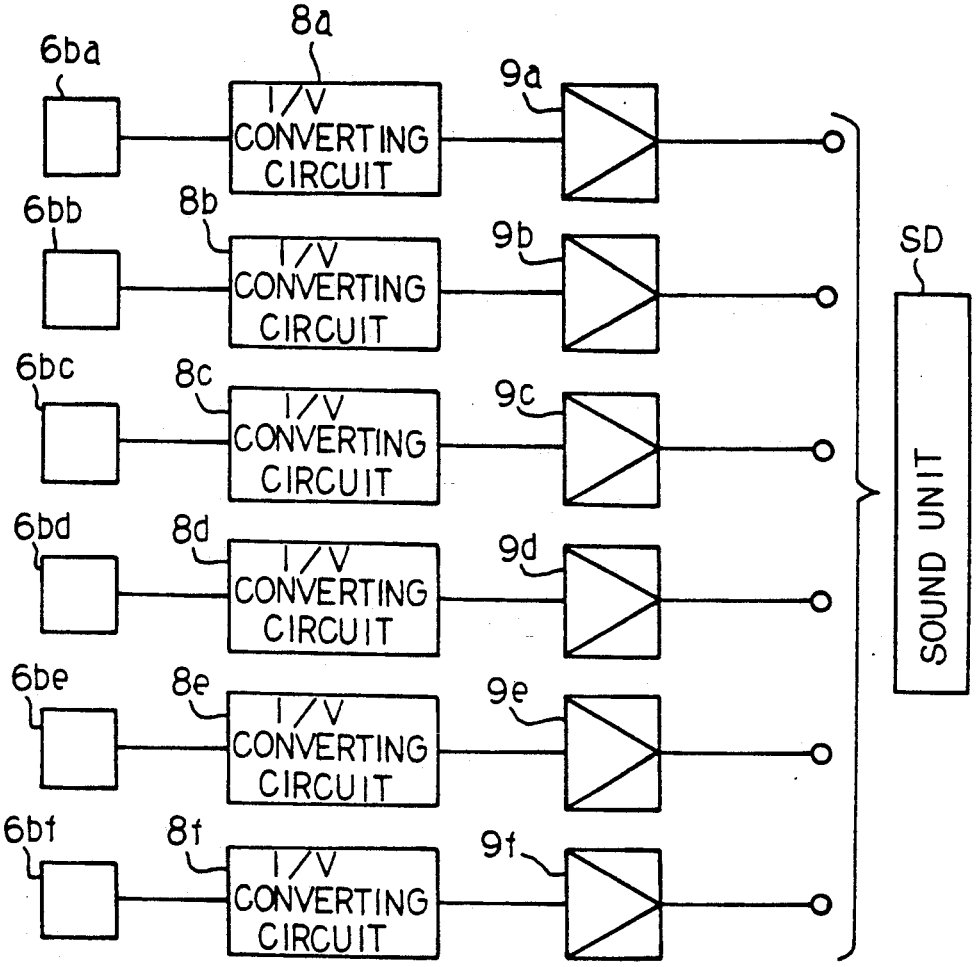
FIG. 3 is a block diagram showing the arrangement of an electric circuit associated with the photo detecting elements.

The photo emitting elements are arranged in a row, and the row direction is substantially perpendicular to a direction in which the strings 3*a* to 3*f* are stretched. The direction in which the strings 3*a* to 3*f* are stretched is hereinbelow referred to as "stretching direction". The photo detecting elements 6*ba* to 6*bf* are also arranged in a row substantially perpendicular to the stretching direction, and are spaced apart from the photo emitting elements 6*ab* to 6*af* in respective directions substantially parallel to the stretching direction. The pairs of photo emitting elements 6*aa* to 6*af* and photo detecting elements 6*ba* to 6*bf* form six photo reflectors, and the six photo reflectors are respectively provided in association with the six strings 3*a* to 3*f* for detecting vibrations produced in the associated strings as will be seen from FIG. 2 of the drawings. The photo emitting elements 6*aa* to 6*af* are coupled with a driving unit 7, and the driving unit 7 supplies power voltage to the photo emitting elements 6*aa* to 6*af* under the control of a suitable controlling unit (not shown). The photo detecting element 6*ba* to 6*bf* are coupled with a current-to-voltage converting unit 8 which in turn is coupled with an amplifying unit 9. The current-to-voltage converting unit 8 is implemented by six current-to-voltage converting circuits 8*a* to 8*f*, and the six current-to-voltage converting circuits 8*a* to 8*f* are coupled in parallel with the six photo detecting elements 6*ba* to 6*bf*. The amplifying unit 9 is also implemented by six voltage amplifying circuits 9*a* to 9*f*, and the six voltage amplifying circuits 9*a* to 9*f* are coupled in parallel with the six current-to-voltage converting circuits 8*a* to 8*f* as will be seen from FIG. 3. The analog voltage signals thus amplified are representative of vibrations of the strings 3*a* to 3*f*, and are used for reproducing sounds by means of a sound unit SD.

Figure 4A:
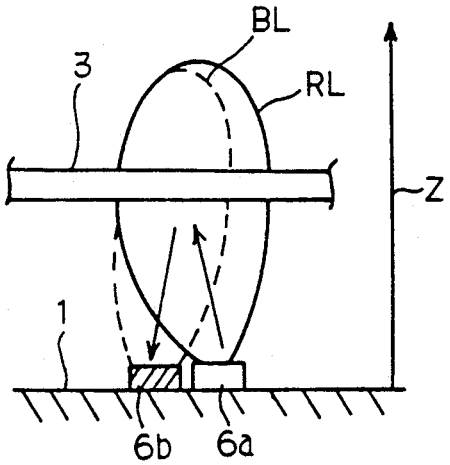
FIGS. 4A and 4B are views different at 90 degrees from each other and showing the location of a string in terms of directivity of the associated photo elements.
Figure 4B:
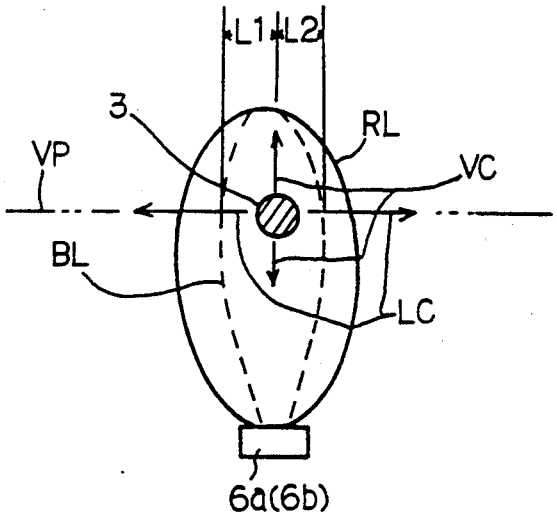

Turning to FIGS. 4A and 4B of the drawings, directivities of the photo elements are illustrated. The photo emitting element 6*a* is representative of any one of the photo emitting elements 6*aa* to 6*af*, and the photo detecting element 6*b* stands for any one of the photo detecting elements 6*ba* to 6*bf*. The photo elements 6*a* and 6*b* are associated with a string 3 representative of any one of the six strings 3*a* to 3*f*. In other words, description on the string 3 associated with the photo elements 6*a* and 6*b* is applicable to any one of the strings 3*a* to 3*f* associated with one of the photo emitting elements 6*aa* to 6*af* and with one of the photo detecting elements 6*ba* to 6*bf*. Real line RL is indicative of a uniform range with a certain intensity, and broken lines BL show a detectable range with the minimum intensity detectable by the photo detecting element 6*b*. The photo elements 6*a* and 6*b* are physically oblique with respect to a vertical direction Z of the rigid body 1, and are arranged in such a manner that the detectable range is partially overlapped with the uniform range, and photo radiation from the photo emitting element 6*a* is fallen upon the lower circular surface of the string 3. However, the overlapped range may be implemented by regulating the directivities of the photo elements 6*a* and 6*b*. The photo radiation is reflected from the lower circular surface, and the reflection is fallen upon the photo detecting element 6*b*. When the string 3 remains stationary, the lower circular surface reflecting the photo radiation is regulated to the mid of the minimum detectable range as will be better seen from FIG. 4B. In other words, the lower circular surface remaining stationary is located at the maximum point of the intensity of the reflection, and is evenly spaced apart from the boundary of the minimum range in directions on a virtual plane VP substantially parallel to the string 3, i.e., L1 is nearly equal to L2. In this instance, the uniform range is wider than the maximum lateral displacement of the string 3. Vibrations of the string 3 have lateral and vertical components parallel to arrows LC and VC, and are converted to the reflection with variable intensity by the photo detecting element 6*b* as will be described hereinbelow in detail.

Figure 5:
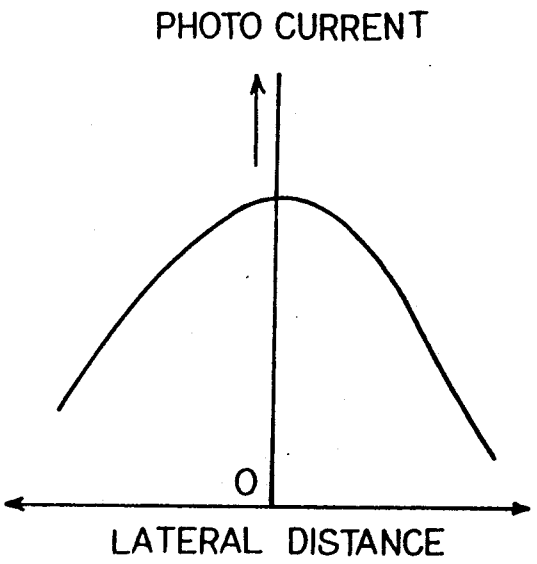
FIG. 5 is a graph showing the amount of photo current produced by the photo detecting element in terms of lateral distance from the maximum point of reflection.
Figure 6:
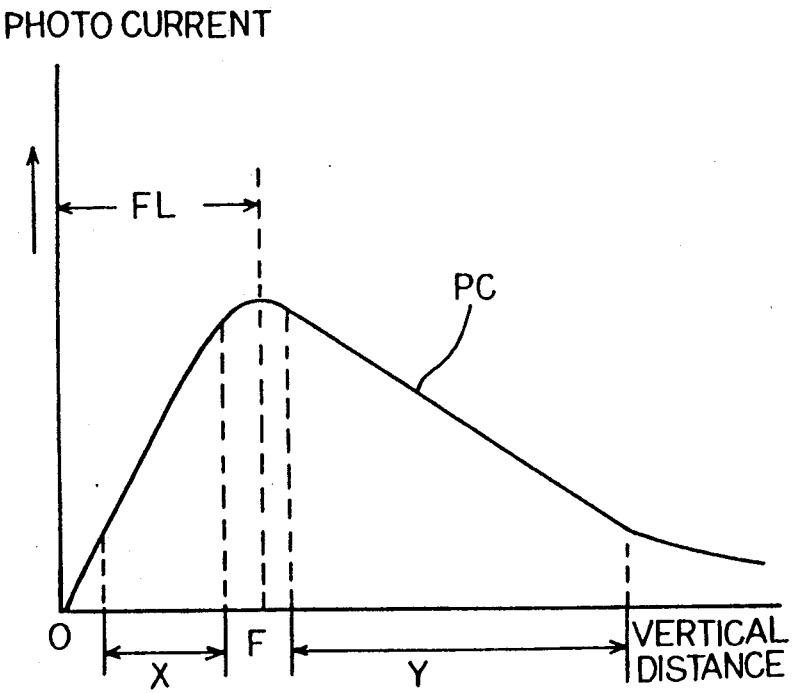
FIG. 6 is a graph showing the photo current produced by the photo detecting element with a predetermined focal length in terms of vertical distance from the photo detecting element.

FIG. 5 shows the amount of photo current produced by the photo detecting element 6*b* in terms of lateral distance from the maximum point. When the string 3 remains stationary, the photo detecting element 6*b* produces the maximum photo current. However, if the string 3 is vibrated, the amount of photo current is varied depending upon the lateral distance, and the lateral displacement of the string 3 is detectable as variation of the photo current. FIG. 6 shows the amount of photo current in terms of the vertical distance from the photo detecting element 6*b* to the string 3, and the photo detecting diode 6*b* is assumed to have a focal length FL. Plots PC is indicative of increasing tendency of the photo current toward the focus point F of the photo detecting element 6*b*, and a linear zone X takes place on the way to the focus point F. The photo current is, then, decreased after reaching the focal point F, and another linear zone Y takes place along plots PC. Since the string 3 hardly exceeds a vertical vibratory range, the photo detecting element 6*b* is selected in such a manner that the vertical vibratory range is fallen within the linear zone X. However, the linear zone Y may be available in another implementation. The photo emitting element 6*a* and the photo detecting element 6*b* thus arranged with respect to the string 3 detect the vibrations of the string 3, and supply the photo current indicative of the vibrations to the current-to-voltage converting unit 8.

As will be understood from the foregoing description, the assembly work is relatively simple rather than the prior arts, because the photo emitting elements 6*aa* to 6*af* and the photo detecting elements 6*ba* to 6*bf* are previously assembled as the detecting unit 6. The worker is merely placed in a pit formed in the rigid body 1, and no adjustment is required after accommodation in the pit, because the depth of the pit has been regulated in such a manner as to cause the vertical vibratory range is fallen within the linear zone X. Moreover, the photo detecting elements 6*ba* to 6*bf* are free from the diffraction of light, and the photo current is substantially proportional to the displacement of the vibrations. For this reason, the electric guitar embodying the present invention is reliable, and can faithfully reproduce sounds.

Although particular embodiments of the present invention have been shown and described, it will be obvious to those skilled in the art that various changes and modifications may be made without departing from the spirit and scope of the present invention.

What is claimed is:

1. An electric stringed musical instrument comprising
   a) a body,
   b) at least one string stretched over said body,
   c) a detecting unit fixed to said body, and located below said at least one string, said detecting unit having at least one photo emitting element for radiating light toward said at least one string, and a photo detecting element for receiving reflection of said light from said at least one string and producing photo current indicative of the intensity of said reflection, said intensity of said reflection being varied when said at least one string is vibrated, variation of said reflection being indicative of vibrations of said at least one string in both lateral and vertical directions, and d) sound producing means supplied with said photo current for producing sounds, said photo detecting element having a detectable range for a minimum intensity of said reflection, said at least one string being located at a midpoint evenly spaced apart from a boundary of said detectable range in directions on a virtual plane substantially parallel thereto when remaining stationary, and said photo detecting element having a focal point beyond said at least one string, said photo current being increased along plots having a linear zone toward said focal point with said at least one string being vibrated within said linear zone.

2. An electric stringed musical instrument as set forth in claim 1, in which said photo emitting element is spaced apart from said photo detecting element in a direction substantially parallel to said at least one string.

3. An electric stringed musical instrument as set forth in claim 1, in which said detecting unit is partially embedded into said body.

4. An electric guitar comprising:

a) a rigid body swingably supporting a tremolo unit, b) a neck projecting from said rigid body, and having pegs;

c) a plurality of strings stretched over said rigid body and said neck between said tremolo unit and said pegs;

d) a detecting unit partially embedded into said rigid body between said tremolo unit and said neck, and having a plurality of photo emitting elements respectively paired with a plurality of photo detecting elements for forming a plurality of photo element pairs respectively associated with said plurality of strings, said plurality of photo emitting elements being spaced apart from said associated photo detecting diodes in respective directions substantially parallel to said associated strings, said plurality of photo emitting elements respectively producing spots of light radiated onto said associated strings, said plurality of photo detecting elements respectively receiving reflections of said spots of light from said associated strings for producing photo currents, each of said photo detecting element having a detectable range for the minimum intensity of said reflection, each of said plurality of strings being located at a mid point evenly spaced apart from the boundary of said detectable range in directions on a virtual plane substantially parallel thereto when remaining stationary, each of said photo detecting element having a focal point beyond said associated string, each of said photo currents being increased along plots having a linear zone toward said focal point, said at least one string being vibrated within said linear zone.

5. An electric stringed musical instrument comprising:

at least one string stretched over a portion of the musical instrument, said at least one string being capable of vibration along a first axis and along a second axis perpendicular to said first axis; and a detecting unit located on one side of said at least one string, said detecting unit further including:

a photo emitting element for radiating light toward said one side; and a photo detecting element for receiving light reflected from said one side and for producing a current proportional to intensity of the received light, variation of said intensity of said received light being indicative of vibrations of said at least one string in both lateral and vertical directions, said photo detecting element having a detection range oriented with respect to said first and second axes such that said at least one string is located at a mid-point along said first axis within said detection range when the at least one string is stationary, and said at least one string has a vibration range along said second axis which corresponds to a linear current output zone of said photo detecting element.

6. An electric stringed musical instrument according to claim 5, wherein said photo detecting element includes a focal point of maximum signal output which is located outside said vibration range of the at least one string along said second axis.

* * * * *